US010601194B1

(12) United States Patent
Chien

(10) Patent No.: US 10,601,194 B1
(45) Date of Patent: Mar. 24, 2020

(54) ELECTRICAL POWER ADAPTER

(71) Applicant: Min-Hung Chien, New Taipei (TW)

(72) Inventor: Min-Hung Chien, New Taipei (TW)

( * ) Notice: Subject to any disclaimer, the term of this patent is extended or adjusted under 35 U.S.C. 154(b) by 0 days.

(21) Appl. No.: 16/145,686

(22) Filed: Sep. 28, 2018

(51) Int. Cl.

| | |
|---|---|
| ***H01R 39/00*** | (2006.01) |
| ***H01R 31/06*** | (2006.01) |
| ***H01R 13/64*** | (2006.01) |
| ***H01R 13/652*** | (2006.01) |
| ***H01R 31/02*** | (2006.01) |
| ***H01R 13/66*** | (2006.01) |
| ***H01R 24/78*** | (2011.01) |
| *H01R 103/00* | (2006.01) |

(52) U.S. Cl.
CPC ..... *H01R 31/06* (2013.01); *H01R 13/64* (2013.01); *H01R 13/652* (2013.01); *H01R 13/6675* (2013.01); *H01R 24/78* (2013.01); *H01R 31/02* (2013.01); *H01R 2103/00* (2013.01)

(58) Field of Classification Search
CPC .... H01R 31/06; H01R 24/78; H01R 13/6675; H01R 31/02; H01R 13/652; H01R 13/64; H01R 2103/00
USPC ..... 439/638, 171, 518
See application file for complete search history.

(56) References Cited

U.S. PATENT DOCUMENTS 5,616,051 A * 4/1997 Rogers ..... H01R 27/00 439/171
5,634,806 A * 6/1997 Hahn ..... H01R 27/00 439/172
5,648,712 A * 7/1997 Hahn ..... H01R 27/00 320/111
6,227,888 B1 * 5/2001 Hahn ..... H01R 27/00 439/172
8,388,352 B1 * 3/2013 ChongYu ..... H01R 24/28 439/11
2009/0225486 A1 * 9/2009 Wadsworth ..... H01R 31/065 361/118
2009/0291570 A1 * 11/2009 Wadsworth ..... H01R 31/065 439/13
2010/0190363 A1 * 7/2010 Green ..... H01R 13/44 439/131

(Continued)

FOREIGN PATENT DOCUMENTS

| | | |
|---|---|---|
| CN | 1316690 C | 5/2007 |
| TW | I251390 B | 3/2006 |

*Primary Examiner* — Abdullah A Riyami
*Assistant Examiner* — Nelson R. Burgos-Guntin
(74) *Attorney, Agent, or Firm* — Dunlap Bennett & Ludwig PLLC

(57) ABSTRACT

A travel power adapter system is provided. The travel power adapter system includes a base unit and a plurality of adapter assemblies. The base unit provides an integral prong configuration associated with an intrinsic electrical plug standard. Each adapter assembly a prong configuration associated with a different extrinsic electrical plug standard. The base unit provides a base recess that the integral prong configuration can pivot into. Each adapter assembly provides coupling sleeves dimensioned to slidably receive the plurality of prongs while nesting in the base recess, whereby an operative association between the integral electrical plug standard of integral prong configuration and the extrinsic electrical plug standard of the adapter assembly, enabling the base unit to be electrically connect to a receptacle associated with the extrinsic electrical plug standard.

16 Claims, 4 Drawing Sheets

(56) References Cited

U.S. PATENT DOCUMENTS

2014/0145689 A1* 5/2014 Carlucci ..... H01R 31/065
323/237
2015/0064955 A1* 3/2015 Liu ..... H01R 24/68
439/344

* cited by examiner

ELECTRICAL POWER ADAPTER

BACKGROUND OF THE INVENTION

The present invention relates to electrical power adapters and, more particularly, to a travel power adapter system providing a track and slide configuration for operatively associating an integral prong configuration of a base unit interchangeably with one of a plurality of adapter assemblies. Each adaptor assembly interconnects the integral prong configuration to a receptacle of an electrical plug standard different than that of the integral prong configuration.

Portable electric-powered and electronic devices are ubiquitous. Such devices may run on AC current from a receptacle, run on a battery in need of recharging via an AC current from such receptacles, or run on a DC current that can be adapted from an AC current from such receptacles. As a result of their portability, such devices may need to be electrically coupled to various types of receptacles as a user travels from country to country, where each receptacle has a different "extrinsic" electrical plug standard than the intrinsic electrical plug standard of the integral prong configuration of the device in question.

As can be seen, there is a need for a travel power adapter system enabling an operative association between the intrinsic electrical plug standard of the base unit and the extrinsic electrical plug standard of one of a plurality of electrical plug standards (e.g., prong configuration, power rating, and frequency) by way of one of a plurality of adapter assemblies. The system embodied in the present invention provides a track and slide functionality enabled by the base unit coupled to each respective adapter assembly.

SUMMARY OF THE INVENTION

In one aspect of the present invention, a travel power adapter system includes a base unit providing: an intrinsic prong configuration; a base recess provided along a top surface of the base unit; and the intrinsic prong configuration pivotal between an outlet position and a nested position within the base recess; and one or more adapter assemblies, each adapter assembly providing: one of a plurality of extrinsic prong configurations; a coupling sleeve providing apertures for slidably receiving the intrinsic prong configuration; and the coupling sleeve dimensioned to slidably nest in the base recess while receiving the intrinsic prong configuration, in an operative associated condition, electrically coupling said extrinsic prong configuration to the intrinsic prong configuration.

In another aspect of the present invention, the travel power adapter system includes a base unit providing: an intrinsic prong configuration; a base recess provided along a top surface of the base unit; and the intrinsic prong configuration pivotal between an outlet position and a nested position within the base recess; and one or more grip slots provided along the top surface adjacent the base recess; and one or more adapter assemblies, each adapter assembly proving: one of a plurality of extrinsic prong configurations; a coupling sleeve providing apertures for slidably receiving the intrinsic prong configuration; the coupling sleeve dimensioned to slidably nest in the base recess while receiving the intrinsic prong configuration, in an operative associated condition, electrically coupling said extrinsic prong configuration to the intrinsic prong configuration, wherein for each adapter assembly the coupling sleeve extends along a bottom surface of said adapter assembly from a peripheral portion to a central portion thereof; and said apertures adjacent to the central portion, wherein each coupling sleeve providing one or more sleeve side protrusions; and wherein the base recess provides side slots dimensioned for each sleeve side protrusion to slide therein in the operative associated condition; and one or more grip nubs provided along the bottom surface of each adapter assembly, wherein the operatively associated condition a secured engagement is formed between the one or more grip slots and nubs.

These and other features, aspects and advantages of the present invention will become better understood with reference to the following drawings, description and claims.

DETAILED DESCRIPTION OF THE INVENTION

Figure 1:
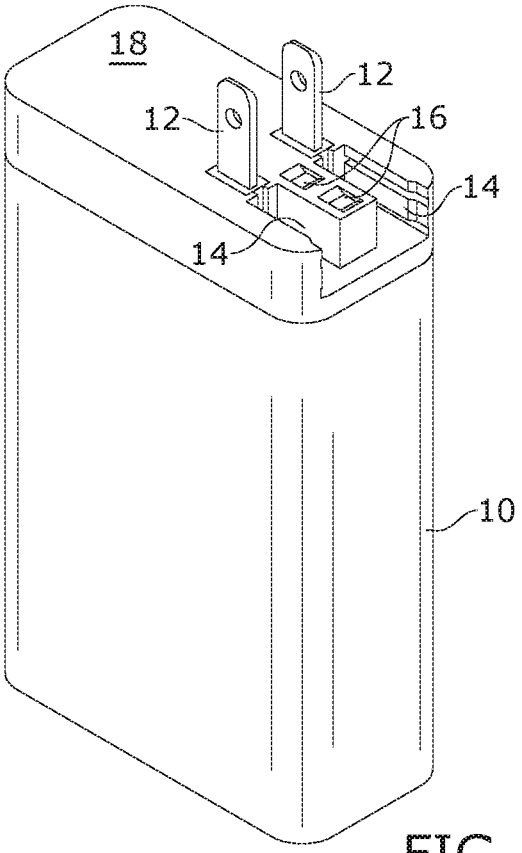
FIG. 1 is a perspective view of an exemplary embodiment of the present invention, shown with an integral prong configuration in an outlet position.
Figure 2:
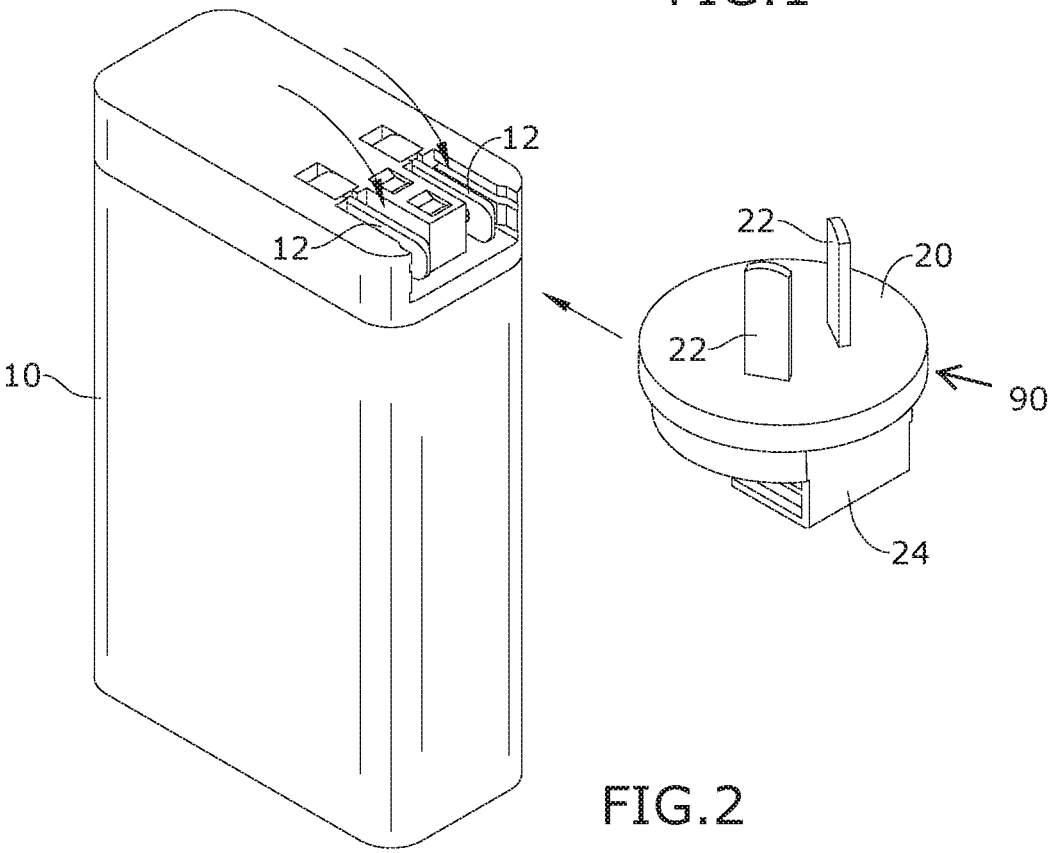
FIG. 2 is a perspective view of an exemplary embodiment of the present invention, illustrating the integral prong configuration pivoting from the outlet position to a nested position, enabling the track and slide functionality for sliding an adaptor assembly into an operative association condition.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a travel power adapter system. The travel power adapter system includes a base unit and a plurality of adapter assemblies. The base unit provides an integral prong configuration associated with an intrinsic electrical plug standard. Each adapter assembly provides a prong configuration associated with a different extrinsic electrical plug standard. The base unit provides a base recess that the integral prong configuration can pivot into in a nested condition. Each adapter assembly provides coupling sleeves dimensioned to slidably receive the plurality of prongs while nesting in the base recess, whereby an operative association between the integral electrical plug standard of integral prong configuration and the extrinsic electrical plug standard of the adapter assembly, enabling the base unit to be electrically connect to a receptacle associated with the extrinsic electrical plug standard.

Referring to FIGS. 1 through 9, the present invention may include a travel power adapter system 100 providing a base unit 10 and a plurality of adaptor assemblies (90: 20 through 80) for operatively associating the base unit 10 having an intrinsic electrical plug standard to various extrinsic electrical plug standards.

The base unit 10 has a plurality of integral prongs 12 arranged in an intrinsic electrical plug standard, such as that of North America. The plurality of prongs 12 are pivotally connected to the base unit 10 so as to move between an outlet position to a nested position within a base recess 14 provided by a top surface 18 of the base unit 10.

The adapter assembly 90 may provide prong configurations that conform to an Australian/New Zealand prong configuration 22, a UK prong configuration 32, an EU prong configuration 42, a Korean EU prong configuration 52, a South African prong configuration 62, a Brazilian prong configuration 72, an Indian prong configuration 82, and/or any other plug standard. Each prong configuration is provided on a separate adapter assembly, 20, 30, 40, 50, 60, 70, and 80, respectively. And each such adapter assembly provides a mounting base 24, 34, 44, 54, 64, 74, and 84, respectively.

Figure 3:
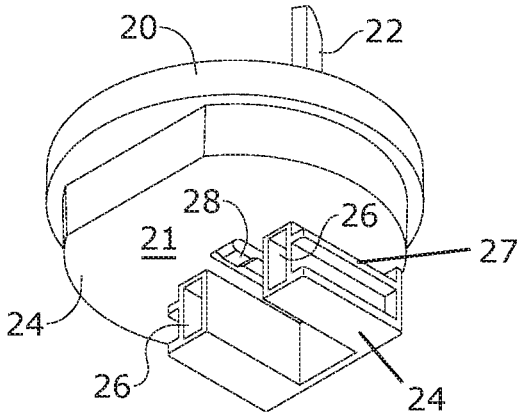
FIG. 3 is a bottom perspective view of the adapter 20 of an exemplary embodiment of the present invention.
Figure 4:
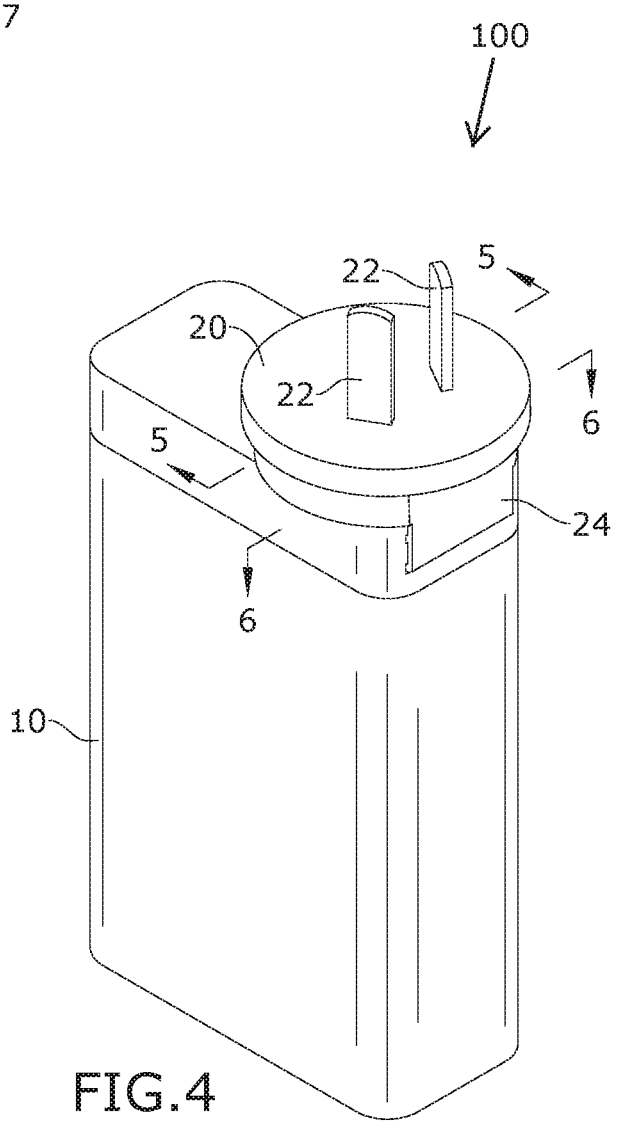
FIG. 4 is a perspective view of an exemplary embodiment of the present invention, shown in the operative association condition.
Figure 5:
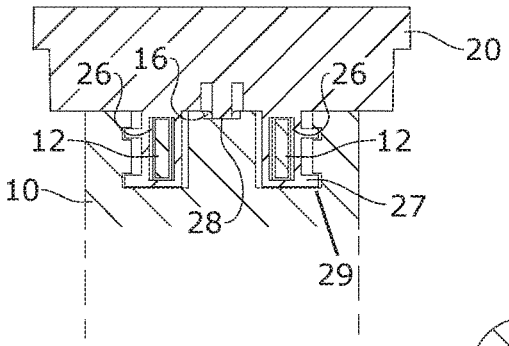
FIG. 5 is a section view of the operative association condition of the adapter assembly 20 and the base unit 10 of an exemplary embodiment of the present invention, taken along line 6-6 in FIG. 4.
Figure 6:
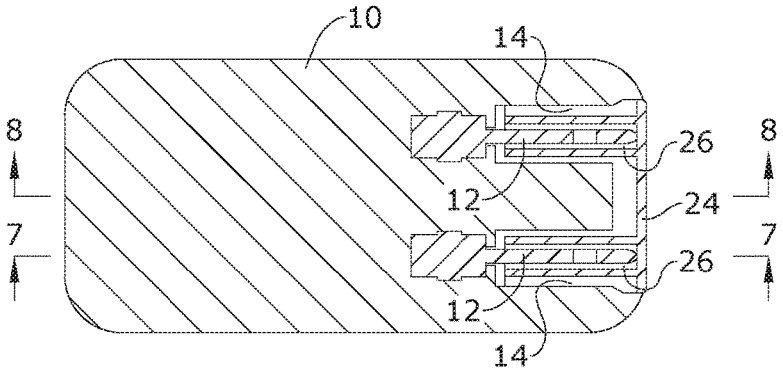
FIG. 6 is a section view of the operative association condition of the coupling sleeves 26 and the base recess 14 of an exemplary embodiment of the present invention, taken along line 5-5 in FIG. 4.
Figure 7:
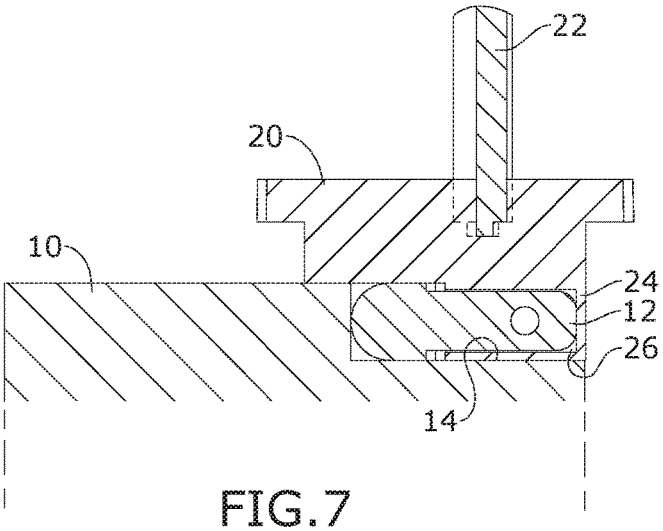
FIG. 7 is a section view of an exemplary embodiment of the present invention, taken along line 7-7 in FIG. 6.
Figure 8:
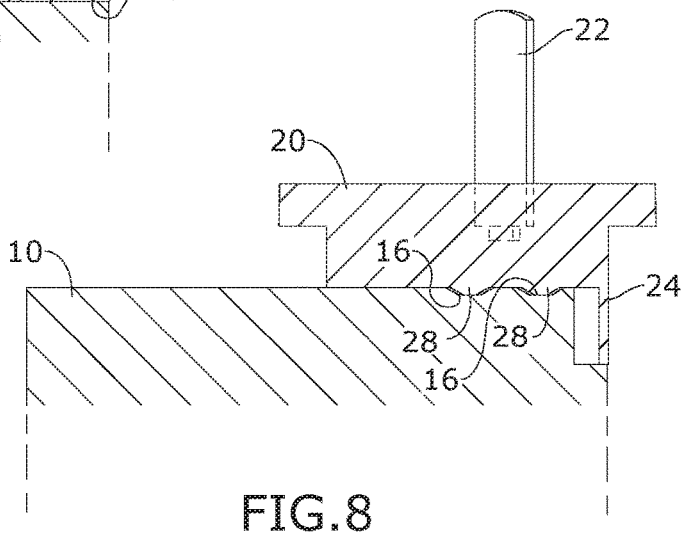
FIG. 8 is a section view of an exemplary embodiment of the present invention, taken along line 8-8 in FIG. 6.
Figure 9:
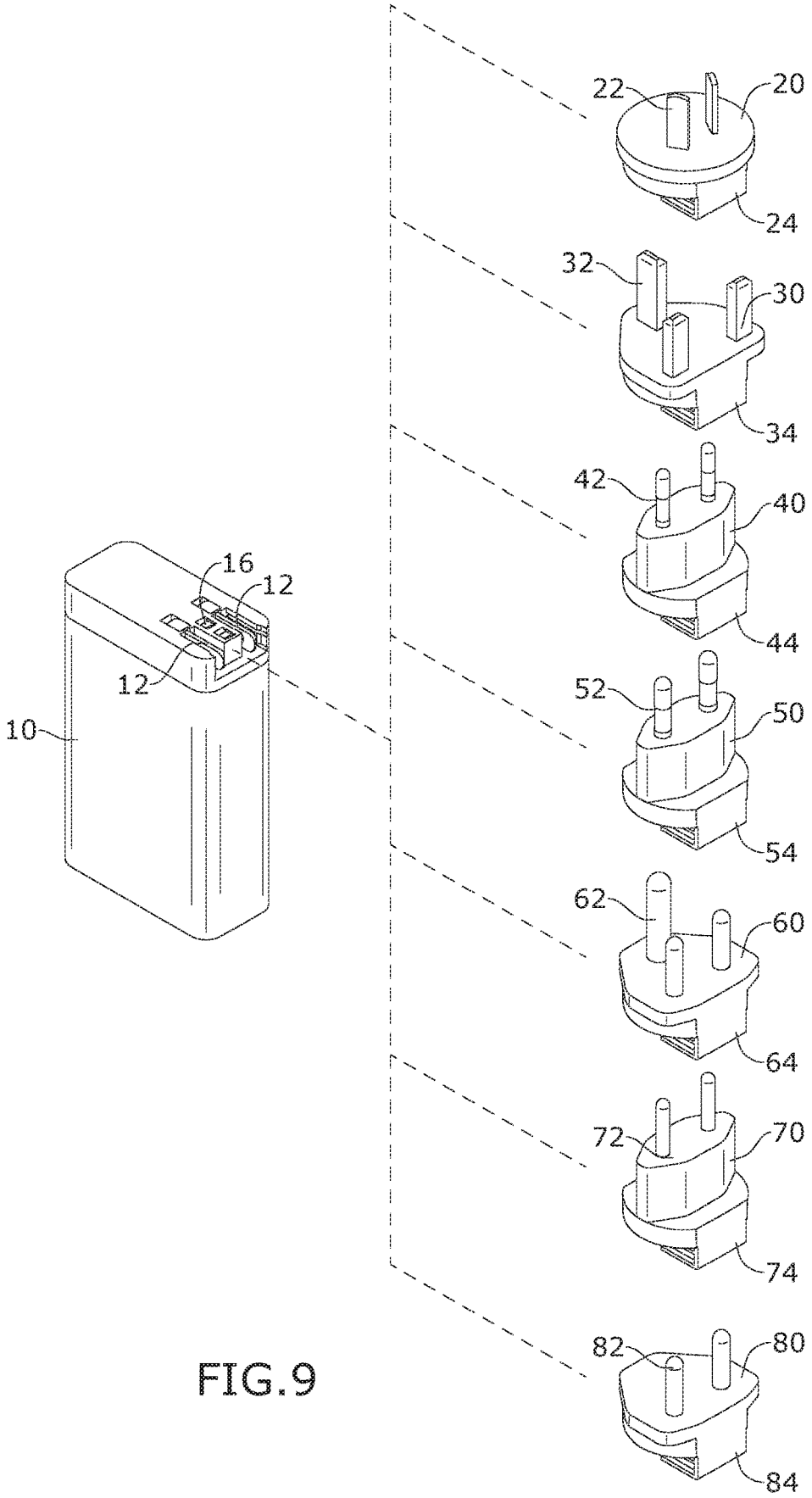
FIG. 9 is a perspective view of an exemplary embodiment of the present invention, showing the interchangeability of multiple adapter assemblies.

Each mounting base 24, 34, 44, 54, 64, 74, and 84 may provide the components shown in FIGS. 3 through 8; specifically, providing coupling sleeves 26 extending along a bottom surface 21 of the adapter assembly. The coupling sleeve 26 generally has a proximal end adjacent to a periphery edge of the bottom surface 21 from which the coupling sleeves 26 extend, terminating at a distal end adjacent to a central portion of the bottom surface 21. If the plurality of prongs 12 are dimensioned and adapted to have a prong configuration associated with the North American standard, as shown in the FIGS., then the coupling sleeves 26 defines a squared-off U-shape, as illustrated in FIG. 3. It being understood that the plurality of integral prongs 12 may be other prong configuration standards, and so the coupling sleeves 26 may take different shapes, but would function according to the disclosure herein.

Each distal end of the coupling sleeves 26 provides an aperture dimensioned and adapted to slidably receive each integral prong of the plurality of prongs 12 of the intrinsic electrical plug standard, thereby operatively associating the plurality of prongs 12 with the extrinsic prong configuration of the adapter assembly 90. In other words, the adapter assembly 90 slides between a removed condition and an operative associated condition, wherein AC power from an electric receptacle or outlet may be electrically connected to the base unit 10/plurality of prongs 12.

In this operatively associated condition, the coupling sleeves 26 nests in base recess 14, as illustrated in FIGS. 5 through 8. The base recess 14 may be dimensioned and adapted to snugly receive the coupling sleeves 26. In this embodiment, the base recess 14 has a U-shape. Each coupling sleeve 26 may provide sleeve side protrusions 27 that slide into and mate with recess side slots 29. These features contribute to the track and slide functionality of the present invention.

Similarly, the top surface 18 of the base unit 10 may provide grip slots 16 adjacent to the base recess 14. The bottom surface 21 of the adapter assembly 90 may provide grip nubs 28 to form, in the operatively associated condition, a secured engagement with the grip slots 16. The secured engagement may also provide an audible "click" sound so that the user knows the operatively associated condition has been configured.

The base unit 10 may be an electrical device, a battery, a DC adapter, or the like in need of forming an AC connection. Thus, by interchanging the adapter assemblies so as to conform with the local plug standard, the base unit 10 may be used with any of the different international plug standards during a user's travel across the globe. Of course, the user could move the plurality of prongs 20 to the outlet position to utilize its intrinsic electrical plug standard directly into a matching electrical receptacle or outlet.

A method of using the present invention may include the following. The travel adapter system 100 disclosed above may be provided. A user finding themselves in need of an AC connection using an electrical plug standard that differs from the intrinsic electrical plug standard of they base unit 10, need only slide the adapter assembly providing the prong configuration that matches the relevant electrical plug standard. The track and slide-in approach embodied in the present invention provides an easy, safe, fool-proof installation step.

It should be understood, of course, that the foregoing relates to exemplary embodiments of the invention and that modifications may be made without departing from the spirit and scope of the invention as set forth in the following claims.

What is claimed is:

1. A travel power adapter system, comprising:

a base unit comprising:

an intrinsic prong configuration;

a base recess recessed in a top surface of the base unit; and the intrinsic prong configuration pivotal between an outlet position and a nested position within the base recess;

one or more adapter assemblies, each adapter assembly comprising:

one of a plurality of extrinsic prong configurations;

a coupling sleeve providing apertures for slidably receiving the intrinsic prong configuration; and the coupling sleeve dimensioned to slidably nest in the base recess while receiving the intrinsic prong configuration, in an operative associated condition, electrically coupling said extrinsic prong configuration to the intrinsic prong configuration;

one or more grip notches provided in the top surface generally in a middle of the intrinsic prong configuration; and one or more grip protrusions provided along a bottom surface of each adapter assembly, wherein the operatively associated condition produces an audible engagement between the one or more grip recesses and protrusions.

2. The system of claim 1, wherein for each adapter assembly the coupling sleeve extends along a bottom surface of said adapter assembly from a peripheral portion to a distal end adjacent a central portion of the bottom surface; and said apertures provided by the distal end.

3. The system of claim 1, wherein each coupling sleeve providing one or more sleeve side protrusions; and wherein the base recess provides side slots dimensioned for each sleeve side protrusion to slide therein in the operative associated condition.

4. The system of claim 1, wherein the extrinsic prong configuration is an Australian/New Zealand prong configuration.

5. The system of claim 1, wherein the extrinsic prong configuration is a UK prong configuration.

6. The system of claim 1, wherein the extrinsic prong configuration is an EU prong configuration.

7. The system of claim 1, wherein the extrinsic prong configuration is a South African prong configuration.

8. The system of claim 1, wherein the extrinsic prong configuration is a Brazilian prong configuration.

9. The system of claim 1, wherein the extrinsic prong configuration is an Indian prong configuration.

10. A travel power adapter system, comprising:

a base unit comprising:

an intrinsic prong configuration;

a base recess recessed in a top surface of the base unit; and the intrinsic prong configuration pivotal between an outlet position and a nested position within the base recess; and one or more grip slots provided along the top surface adjacent the base recess; and one or more adapter assemblies, each adapter assembly comprising:

one of a plurality of extrinsic prong configurations;

a coupling sleeve providing apertures for slidably receiving the intrinsic prong configuration;

the coupling sleeve dimensioned to slidably nest in the base recess while receiving the intrinsic prong configuration, in an operative associated condition, electrically coupling said extrinsic prong configuration to the intrinsic prong configuration, wherein for each adapter assembly the coupling sleeve extends along a bottom surface of said adapter assembly from a peripheral portion to a central portion thereof; and said apertures provided adjacent the central portion, wherein each coupling sleeve providing one or more sleeve side protrusions;

one or more grip notches provided in the top surface generally in a middle of the intrinsic prong configuration; and one or more grip protrusions provided along a bottom surface of each adapter assembly, wherein the operatively associated condition produces an audible engagement between the one or more grip recesses and protrusions.

11. The system of claim 10, wherein the extrinsic prong configuration is an Australian/New Zealand prong configuration.

12. The system of claim 10, wherein the extrinsic prong configuration is a UK prong configuration.

13. The system of claim 10, wherein the extrinsic prong configuration is an EU prong configuration.

14. The system of claim 10, wherein the extrinsic prong configuration is a South African prong configuration.

15. The system of claim 10, wherein the extrinsic prong configuration is a Brazilian prong configuration.

16. The system of claim 10, wherein the extrinsic prong configuration is an Indian prong configuration.

* * * * *